United States Patent [19]

Haskins et al.

[11] Patent Number: 4,720,269

[45] Date of Patent: Jan. 19, 1988

[54] MODULAR TELEPHONE JACK WITH ELASTOMERIC CONTACT MEMBER

[75] Inventors: Steve W. Haskins, Juliet; John R. McFarland, Gallatin, both of Tenn.

[73] Assignee: Northern Telecom Limited, Montreal, Canada

[21] Appl. No.: 24,024

[22] Filed: Mar. 10, 1987

[51] Int. Cl.[4] ..... H01R 13/11

[52] U.S. Cl. ..... 439/90

[58] Field of Search ..... 439/66, 78, 81, 86, 439/90, 91

[56] References Cited

U.S. PATENT DOCUMENTS 4,109,378 8/1978 Davis ..... 439/91

4,295,699 10/1981 Du Rocher ..... 439/86

*Primary Examiner*—Joseph M. McGlynn

*Attorney, Agent, or Firm*—Schwartz, Jeffery, Schwaab, Mack, Blumenthal & Evans

[57] ABSTRACT

A modular jack for a telephone set comprises a hollow housing having an elastomeric contact member extending across at the junction of the end wall and the bottom wall. The contact member has a plurality of parallel conductive contact members on its surface positioned to make contact with terminals of a modular plug. The contact members also extend out of the housing to make contact with a circuit pattern on a circuit board on which the jack is mounted.

12 Claims, 14 Drawing Figures

MODULAR TELEPHONE JACK WITH ELASTOMERIC CONTACT MEMBER

BACKGROUND OF THE INVENTION

1. Field of the Invention

This invention relates to modular telephone jacks.

2. Related Art

Conventional jacks comprise a molded plastic housing having a plurality of cantilevered spring contact members. On insertion of a modular plug, the spring contact members each contact a terminal in the plug. The jack has a front opening which is profiled to ensure correct orientation of the plug. A deflectable cantilever locking member holds the plug in position in the jack.

Each cantilevered spring contact member generally comprises a spring wire forward end which is formed to produce the actual contact portion, and a rear part, usually attached as by crimping to the forward part. The rear part may be a flexible conductor for connection to a terminal or may be a lead for insertion in a circuit board for example.

A jack usually has four or six spring terminals. The assembly of a jack therefore requires manufacture of the contact members and then the insertion of the required number of contact members in the jack molding.

SUMMARY OF THE INVENTION

The present invention provides an elastomeric contact member which can be snapped into the jack housing, and provides direct contact between the terminals of a plug and a circuit pattern on a support member. Particularly, the contact member can make contact with the circuit pattern on a circuit board on which the jack is mounted.

Broadly, the present invention provides a modular jack having a hollow housing, the housing having a profiled entrance for a modular jack, and an elastomeric contact member in the jack, the elastomeric contact member having a plurality of electrically conductive contact portions on a surface thereof, the contact portions providing direct electrical connection between terminals in a plug and contact areas on a circuit pattern on a support member. The jack can be mounted on a circuit board with the contact portions making contact with the circuit pattern on the circuit board. The jack can be molded as part of a telephone set housing.

BRIEF DESCRIPTION OF THE DRAWINGS

The invention will be readily understood by the following description of certain embodiments, by way of example, in conjunction with the accompanying drawings, in which.

DETAILED DESCRIPTION OF THE DRAWINGS

Figure 1:
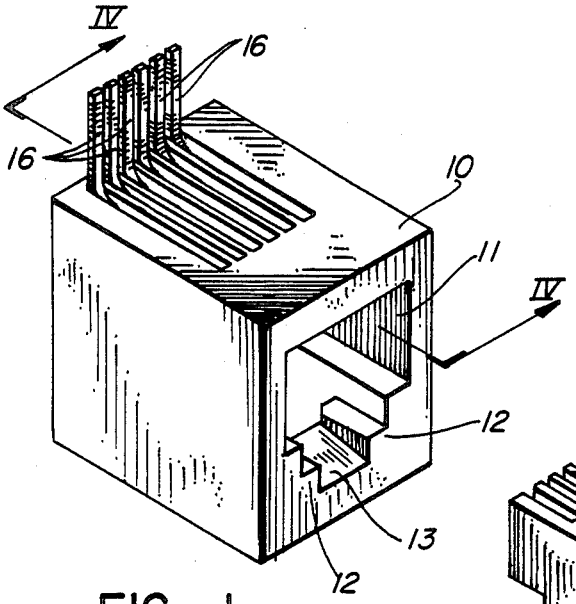
FIG. 1 is a perspective view of one form of conventional jack.
Figure 4:
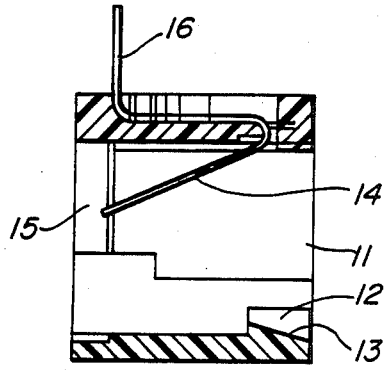
FIG. 4 is a cross-section, generally on the line IV—IV of FIG. 1.

Considering FIG. 1, a conventional modular jack has a hollow box-like housing 10, with a profiled entrance aperture 11. The profile at 12 ensures correct orientation of a plug. A central ramp portion 13 forms a step behind which a latch member engages when a plug is inserted. The housing, seen also in cross-section in FIG. 4, has a plurality of cantilevered spring contact members 14 projecting into the hollow interior. The free ends of the contact members are positioned in slots formed in the back wall 15. The other ends of the contact members, in the example, are connected to leads 16 which connect the contact members to a circuit.

Figure 2:
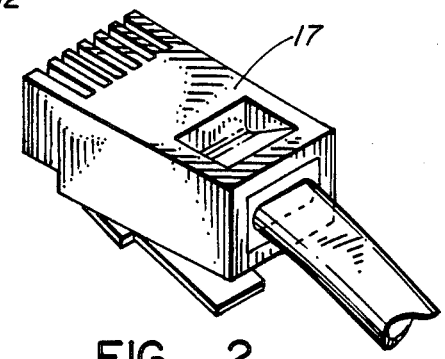
FIGS. 2 and 3 are isometrical views on the opposite sides of a plug as inserts into the jack of FIG. 1.
Figure 3:
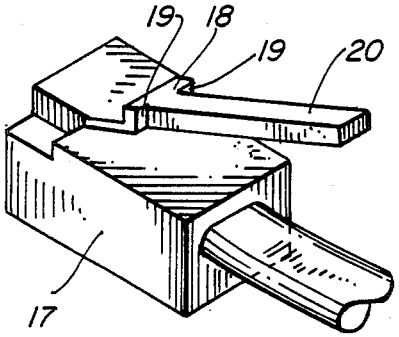

A plug 17 (FIGS. 2 and 3) inserts into the housing 10, the latch 18 sliding up the ramp 13. Shoulders 19 on either side of the latch engage behind the formations 12 at the entrance to the housing. An extension 20 on the latch enables the latch to be disengaged for removal of the plug from the jack.

The jack and plug, as illustrated in FIGS. 1 to 4, are conventional and are one of various forms of modular jack and plug.

Figure 5:
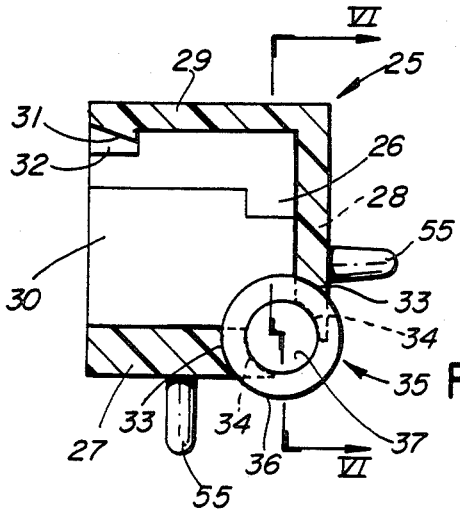
FIG. 5 is a cross-section through a jack according to one embodiment of the invention, on the line V—V of FIG. 6.
Figure 6:
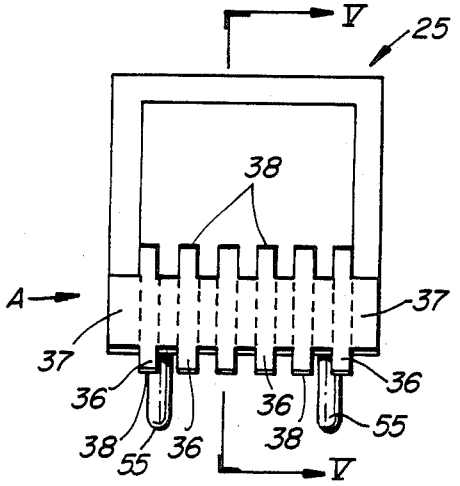
FIG. 6 is a cross-section on the line VI—VI of FIG. 5.
Figure 7:
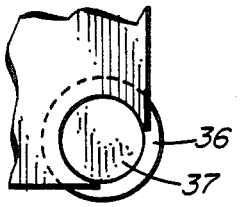
FIG. 7 is a partial side view, in the direction of arrow A in FIG. 6.
Figure 8:
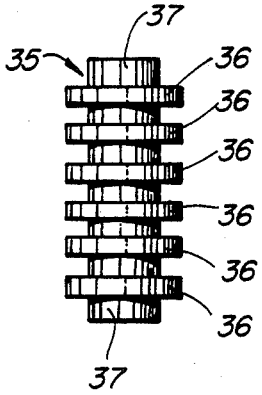
FIG. 8 is a plan view of the elastomeric contact member as used in the embodiment of FIGS. 5, 6 and 7.

FIGS. 5, 6 and 7 illustrate one form of modular jack embodying the invention. The jack, indicated generally at 25, is reversed top to bottom relative to FIGS. 1 to 4. The jack comprises hollow housing 26 having a bottom wall 27, an end wall 28, and top wall 29. The entrance, at 30, is profiled, as in FIG. 1. A ramp 31 and a formation 32 provide the entrance and step for a plug latch. Formed in the corners at the junction of bottom wall 27 and end wall 28, a cylindrical transverse channel 33 is formed. At each end, a smaller diameter channel 34 is formed, seen in FIG. 7. Into the channel 33 is snapped a cylindrical elastomeric contact member 35. Contact member 35 is seen in FIG. 8, and in longitudinal cross-section in FIG. 6. The contact member is in the form of a cylindrical roller, having peripherally extending electrically conducting ribs or rings 36. The ends 37 of the roller snap into the smaller diameter channels 34, while the ribs or rings 36 are a snap fit into the channel 33. Conveniently, the ribs 36 need only have a relatively thin layer of conductive material on their peripheral surfaces. This layer is indicated at 38 in FIG. 6. In an alternative form, the main cylindrical body of the contact member, of insulating material, can have the ribs 36 molded onto it. In a further form, the contact member can be made of alternate discs of larger and smaller diameter, the smaller discs being of insulating material. Many other ways of forming the contact member 35 are possible.

Figure 9:
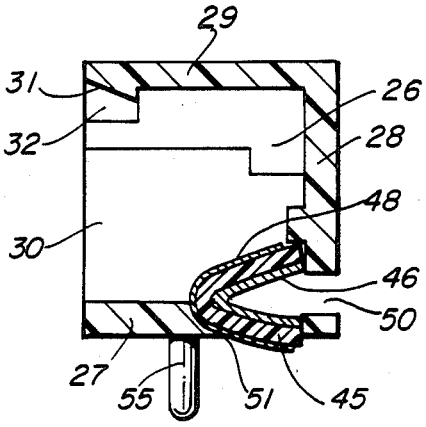
FIG. 9 is a cross-section, similar to that of FIG. 5, illustrating another embodiment.
Figure 10:
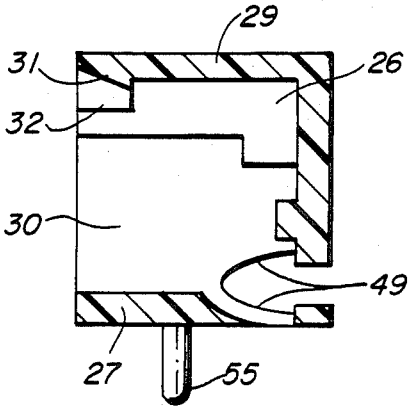
FIG. 10 is a cross-section, as in FIG. 9, but of the housing only, with the contact member removed.
Figure 11:
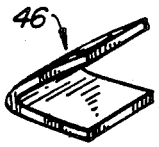
FIG. 11 is a perspective view of a metal forming member as used in FIG. 9.
Figure 12:
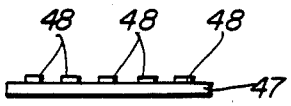
FIGS. 12 and 13 are end view and plan view, and respectively, of the elastomeric contact member as used in FIG. 9.
Figure 13:
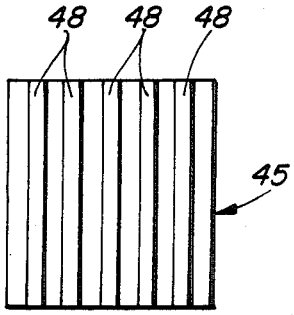

FIG. 9 illustrates an alternative form of elastomeric contact member. Common reference numerals are used with FIGS. 5 and 6 for the same items. In the arrangement of FIGS. 9 and 10, contact member 45 is in the form of an originally flat member, bent round a forming member 46. The contact member 45 is seen in its unformed shape in FIGS. 12 and 13. The member has a base portion 47 on which are formed a plurality of spaced parallel ribs 48. The ribs 48 are of conducting material, the base portion being a dielectric. The forming member 46 is seen in FIG. 11. The forming member can be of metal, or can be of relatively rigid plastic material for example. It should have some resilience so that it can snap into shaped apertures 49 in the side walls of the housing of the jack. In use, the contact member is folded over the forming member and pushed into the housing through a slot 50 in the end wall 28. The ends of the forming member snap up behind the end wall. The lower part of the contact member extends partly through a slot 51 in the bottom wall 27. When a plug is inserted, the terminals of the plug make contact with the ribs 48 on the upper part of the contact member, positioned in the housing 26. The ribs on the lower part of the contact member make contact with contact areas of a circuit pattern on a support member, such as a circuit board.

In FIGS. 5 and 6, posts 55 are shown extending from the bottom wall 27 and the end wall 28. These provide a means for mounting the jack on a circuit board, for example. The posts pass through holes in the board and are then heat staked over to hold the jack in position. Posts need be provided on only one wall, as in FIGS. 9 and 10, depending upon mounting orientation. Other means for mounting the jack can be provided.

Figure 14:
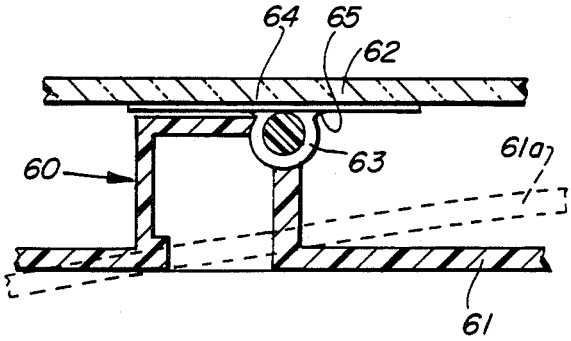
FIG. 14 is a cross-section, somewhat similar to that of FIG. 5, with the jack housing molded as part of a telphone set housing.

The jack can readily be made as part of a larger assembly. Thus, the jack housing can be molded as part of a telephone set housing. FIG. 14 illustrates very diagrammatically a jack 60 of the form as in FIG. 5 formed integrally with a telephone set base housing 61. A plug is inserted into the jack from the bottom surface of the base. The housing can be recessed at this position, and grooves can be formed in the base surface for a telephone cord extending from the jack. A circuit board 62 can be positioned in the base to engage with the contact member 63. On assembly, the circuit pattern 64 on the circuit board will be pressed into contact with the contact member and a deformation of the conductive rings will occur, as illustrated at 65. The base 61 can be angled relative to the circuit board 62, as illustrated in dotted outline at 61*a*.

On insertion of a plug into a jack, there will be some slight deformation of the rings 36 of the arrangement of FIG. 5 and of ribs 48 of the arrangement of FIG. 9. This deformation, and sliding action of the plug, will give a wiping action at the contact surfaces, a desirable feature.

What is claimed is:

1. A modular telephone jack having a hollow housing, said housing having a profiled entrance aperture at a front surface, and side, end and bottom walls, an elastomeric contact member mounted in said housing at the junction of said end and bottom walls, said contact member having a plurality of spaced parallel electrically conductive contact portions on a surface thereof extending into said housing, the contact portions spaced and positioned to align with the contact members of a plug.

2. A telephone jack as claimed in claim 1, said elastomeric contact member comprising a flexible strip base member of non-conducting material and a plurality of spaced parallel ribs on a surface of the base member, at least a top surface of each rib being of conductive material, a forming member having a generally Vee-shape viewed at an end; a Vee-shaped aperture in each side wall at the junction between said end wall and said bottom wall, the open end of the Vee-shape towards said end wall; a slot in said bottom wall extending between said side walls, immediately adjacent to said end wall; said forming member extending across said housing, opposite ends of the forming member positioned in said apertures; said contact member extending round outside said forming member, said ribs extending outward and in a direction normal to said end wall, an end portion of said contact member extending through said slot in said bottom wall.

3. A telephone jack as claimed in claim 1, including at least one post extending from said bottom wall for mounting on a circuit board, said ribs on said end portion of said contact member arranged to make contact with a circuit pattern on said circuit board.

4. A telephone jack as claimed in claim 1, said contact portions extending beyond at least one of said end wall and bottom wall.

5. A telephone jack as claimed in claim 4, including Posts extending from said at least one of said end wall and bottom wall, for mounting on a circuit board, said contact portions arranged also to make contact with contact positions on said circuit board.

6. A telephone jack as claimed in claim 1, said elastomeric contact member comprising a cylindrical member, said conductive contact portions comprising peripherally extending ribs, at least the surface of each rib being electrically conductive.

7. A telephone jack as claimed in claim 6, said cylindrical member comprising a cylindrical roller, said peripherally extending ribs extending for the periphery of the roller; a cylindrical aperture in each side wall at said junction of said end and said bottom walls; a cylindrical channel formed across said housing at said junction, said cylindrical roller positioned at each end in said cylindrical apertures and said ribs positioned in said channel.

8. A telephone jack as claimed in claim 6, including an electrically conductive layer on each of said ribs.

9. A telephone jack as claimed in claim 6, said ribs extending beyond at least one of said end wall and bottom wall for contact with a circuit pattern on a circuit board.

10. A telephone jack as claimed in claim 9, including posts on at least one of said end wall and bottom wall, for mounting said jack on a circuit board.

11. A telephone jack as claimed in claim 10, including a circuit board, said posts extending through said circuit board, and said ribs in connection with a circuit pattern on said circuit board.

12. A telephone jack as claimed in claim 11, said ribs being resiliently deformed in contact with said circuit pattern.

* * * * *